United States Patent [19]

Falgout, Sr.

[11] Patent Number: 4,834,196

[45] Date of Patent: May 30, 1989

[54] WELL DRILLING TOOL

[76] Inventor: Thomas E. Falgout, Sr., Rte. 2, Box 11B, Youngsville, La. 70592

[21] Appl. No.: 64,596

[22] Filed: Jun. 22, 1987

[51] Int. Cl.[4] ..... E21B 7/08

[52] U.S. Cl. ..... 175/74; 175/256; 175/321

[58] Field of Search ..... 175/73, 74, 61, 256, 175/321, 322, 231

[56] References Cited

U.S. PATENT DOCUMENTS

| | | | |
|---|---|---|---|
| 2,197,019 | 4/1940 | Monroe | 175/256 X |
| 2,536,452 | 1/1951 | Leissler | 175/256 X |
| 2,680,005 | 6/1954 | Storm | 255/1.6 |
| 2,819,039 | 1/1958 | Lindsay et al. | 175/73 |
| 3,131,778 | 5/1964 | Emerson et al. | 175/256 X |
| 3,457,999 | 7/1969 | Massey | 175/256 X |
| 3,893,523 | 7/1975 | Jeter | 175/74 |
| 4,596,294 | 6/1986 | Russell | 175/74 |
| 4,655,299 | 4/1987 | Schoeffler | 175/38 |

FOREIGN PATENT DOCUMENTS

| | | | |
|---|---|---|---|
| 969881 | 2/1981 | U.S.S.R. | |
| 1239249 | 6/1986 | U.S.S.R. | 175/61 |

*Primary Examiner*—Hoang C. Dang
*Attorney, Agent, or Firm*—John D. Jeter

[57] ABSTRACT

A drilling tool having a body that functions as a length of drill string and telescopes to shorten the body each time column load is applied by way of applied bit load. The telescoping action causes a cam turret in the body to change position to cause one of two possible conditions to exist while drilling. In one condition the body centerline is held straight while drilling. In the second condition the lower portion of the body is laterally deflected for changing the course of the well bore while drilling proceeds. Optional features cause a mud pressure signal to be generated, for detection at the surface, when selected elements in the apparatus are in preselected positions.

6 Claims, 3 Drawing Sheets

WELL DRILLING TOOL

This invention pertains to down hole well drilling equipment for use on a rotary drill string to control the course of a well bore being drilled. More specifically, it pertains to apparatus controllable from the earth surface to cause the centerline of the bottom hole assembly to be either straight while drilling or to be deflected while drilling.

BACKGROUND

In well drilling activity, "straight hole drilling" commonly means that whatever the direction and angle (course) of an existing well bore, that course is being maintained as the well is deepened. The expression "directional drilling" usually implies that active efforts are being made to control or change the course of a progressing well bore.

The Bottom Hole Assembly (BHA) has traditionally been selected and assembled at the surface for a specific action down hole during an entire run. In conjunction with Measurement While Drilling (MWD) equipment, the special assemblies and the related art leaves little to be desired in terms of effect. The operational costs have been high because the special assemblies require a round trip to change effect sought downhole while drilling.

With the advent of MWD equipment the demand for precision and accuracy of down hole deflecting equipment has eased because the effect being accomplished can be continually judged. With exactness demands related, apparatus that will deflect on command and remain straight on command and drill in either condition, and do so reliably is more practical.

It is therefore an object of this invention to provide apparatus controllable from the earth surface to cause the centerline of the down hole drilling assembly to be straight for drilling or deflected for drilling selectively.

It is another object of this invention to provide apparatus to cause the centerline of a down hole drilling assembly to be straight for drilling or deflected for drilling in response to the repeated application of bit loads.

It is still a further object of this invention to provide apparatus with a telescoping body with intrinsic hinge means that will deflect upon selected instances of the application of bit load in a series of instances of the application of bit load.

It is still another object of this invention to provide apparatus to cause a change in pressure at the standpipe when the downhole deflecting tool is in selected modes of operation.

These and other objects, advantages, and features of this invention will be apparent to those skilled in the art from a consideration of this specification, including the attached drawings and appended claims.

SUMMARY OF THE INVENTION

A drilling tool having a body that functions as a length of drill string and telescopes to shorten the body in response to column load that results from bit load application. The telescoping action causes a cam turret in the body to change position each time bit load is applied. The cam position change causes one of two possible conditions to exist each time bit load is applied. In one condition the body centerline is held straight while drilling. In the second condition the lower portion of the body is laterally deflected and held for drilling to change the well bore course.

An optional feature provides a valve that will create a brief pulse in the drilling fluid stream when the internal parts of the apparatus move through preselected configurations so that an indication of that condition can be seen, in fluid pressure, at the earth surface.

Various features incidental to manufacturing and maintenance utility, such as threaded joints, welded junctures and the like, but not bearing on points of novelty, are omitted from the drawings in the interest of descriptive clarity.

DETAILED DESCRIPTION OF DRAWINGS

Figure 1:
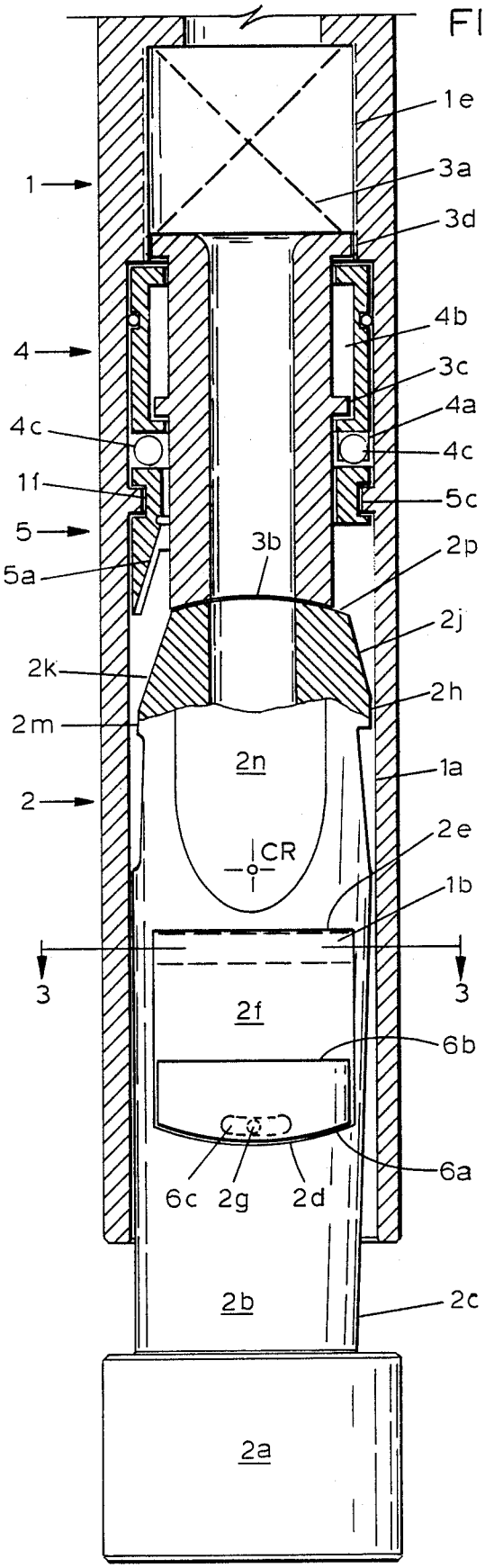
FIG. 1 is a side elevation, partly cutaway, of the tool with body extended.
Figure 3:
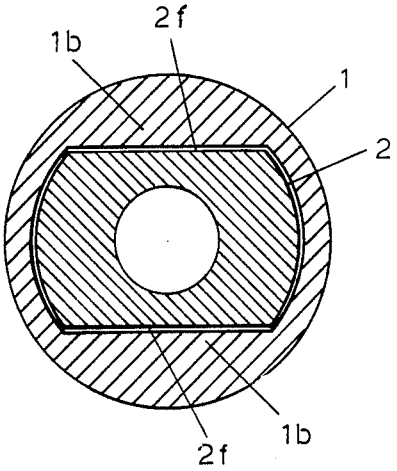
FIG. 3 is a section taken through the tool of FIG. 1 taken along line 3—3.
Figure 2:
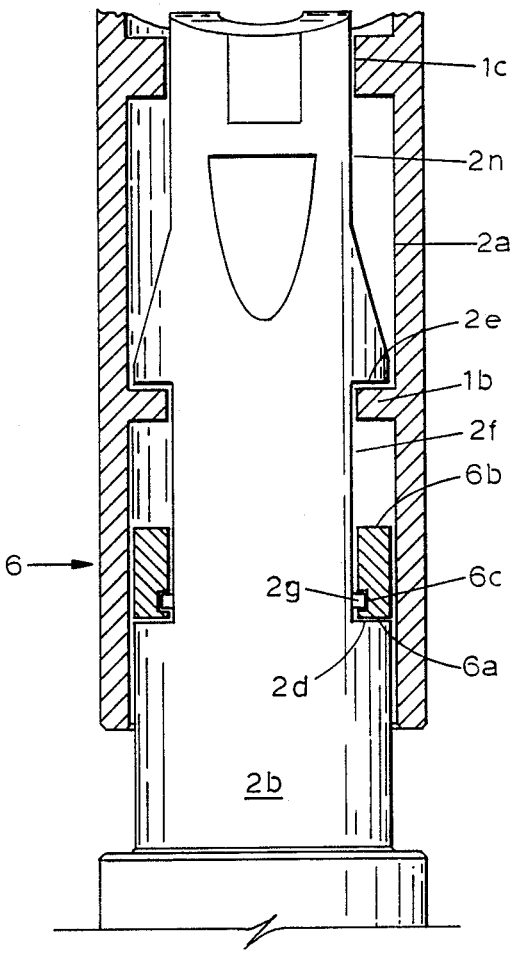
FIG. 2 is an orthagonal view of the tool of FIG. 1, partly cut away.

In the drawings, wherein like features have like captions, FIG. 1 shows a body comprised of an upper portion 1 and a lower portion 2, part of which is telescopingly received into bore 1*a* of portion 1. Lower portion 2 can pivot about axis CR because a clearance 2*c* is cut off one side of extension 2*b* to allow, in this case, two degrees of deflection. Arcuate sectors 6, one on each side, axially support portion 2 by processes best described with FIG. 2 in view. FIG. 2 is a side view of FIG. 1. Sectors 6 have arcuate lower surfaces, struck from center of radius CR. Surfaces 6*a* are in contact with surfaces 2*d* and are retained there by shoulder screws 2*g* in arcuate slots 6*c*.

The body may be welded up from the various shapes shown.

Drive bars 1*b* provide support for surface 6*b* of sectors 6 when portion 2 moves upward relative to portion 1 to the travel limit, and they convey torque between portions 1 and 2 by bearing on surface 2*f*. Bars 1*b* retain portion 2 in portion 1 by supporting surface 2e when portion 2 is at the lower limit of relative travel.

As viewed in FIG. 2, axial alignment of the overall body is maintained by a reasonably close fit between extension 2*b* and bore 1*a* as well as a reasonably close fit between flattened faces 2*n* and guide planes 1c on portion 1.

In FIG. 1, the overall body axis is straight. Portion 2 of the body has moved down by gravity and bias and the lower body centerline can freely deflect to the right but not to the left because bearing block 2*h* engages the wall of bore 1*a*. The bearing block 2*m* is spaced from the wall of bore 1*a* enough to allow two degrees of rotation about point CR. There is no bit load on the suspended tool and the body is telescoped out to maximum length. The tool never drills (takes column load)

in this state and loose coupling serves a purpose in freeing up machine elements for position changing.

The tool in FIG. 1 is prepared to drill straight when bit load is applied. With bit load applied; portion 1 moves downward shortening the body. Cam surfaces 2*k* move up to engage cam surfaces 5*a*.

Cams 5*a*, 2*j* and 2*k* may be regarded as deflection control cams comprising first cam 2*k*, second cam 2*j* and movable third cam 5*a*.

Bearing block 2*h* is forced solidly against the wall of bore 1*a*. Washpipe 3 moves upward overcoming spring 3a. Arcuate surfaces 2*p* and 3*b* remain in contact to conduct fluid from bore 1d, through washpipe 3, through body portion 2 and to the downwardly continuing drill string (not shown) attached to tool joint box 2*a*. The downwardly continuing drill string will usually include a motor and drill bit but may include a jet bit only or other drilling contrivance.

Figure 4:
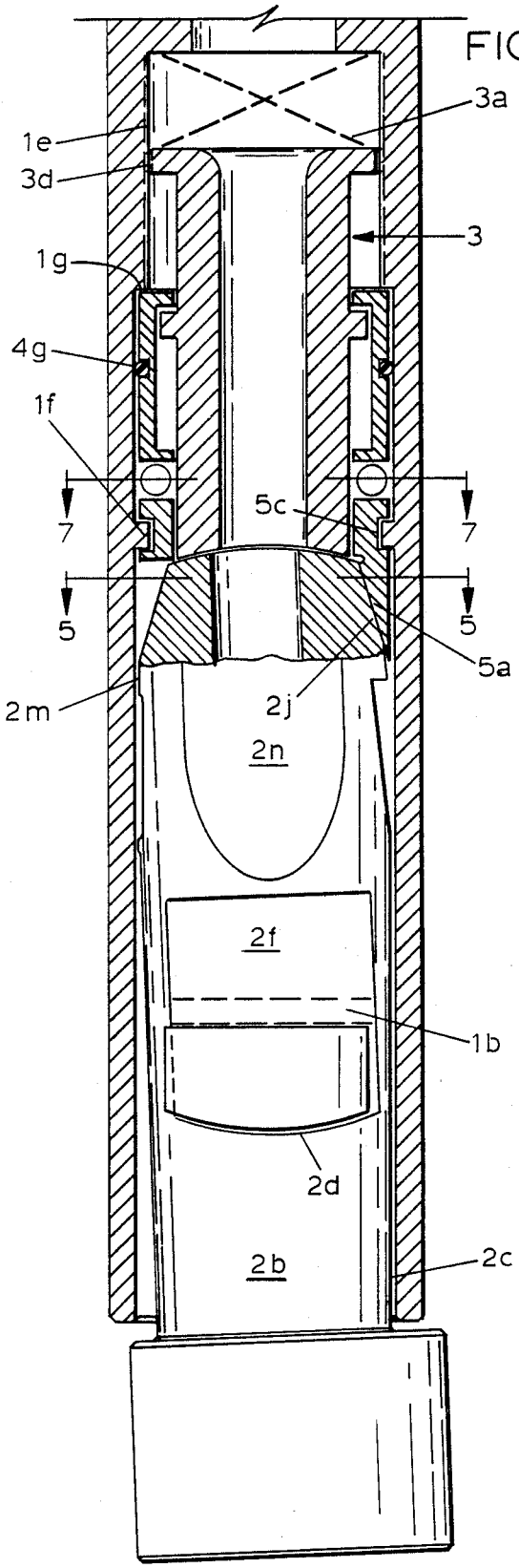
FIG. 4 is identical to FIG. 1 but in the deflected configuration and shortened by column load.

FIG. 4 is identical to FIG. 1 except position of parts. Cam 5*a* has been rotated 180 degrees and portion 1 has been thrust down on portion 2 as bit load produced column load that shortened the body. Portion 2 is deflected right two degrees. Cam surface 5*a* bears on cam surface 2*j* and thrusts bearing block 2*m* against the wall of bore 1*a*. Sector 6 is carrying bit load from surface 2*d* to the lower surface of bars 1*b*. Surface clearance 2*c* allows two degrees of angular deflection, then bears on the wall of of bore 1*a*. Drilling can only occur with bit load and, with bit load, portions 1 and 2 are locked together with no remaining free motion.

It is preferred to have the centerline of the body locked straight when bit load is applied and locked deflected when bit load is relieved and reapplied. Repeating the process of relieving the reapplying bit load shifts back to straight configuration and the alternating process can continue indefinitely with the alternate configuration occurring at alternate instances of bit load application.

The change in body length with change in load is used to shift cam 5*a* between positions opposing cam surfaces 2*k* and 2*j*. The cam system 5 cannot be easily rotated while cam surfaces are loaded and shifting of cam positions is carried out while the body lengthens during bit load reduction. Actually, cam 5*a* is not rotated 180 degrees each time bit load is applied but the effect is accomplished by using a five cam ring and rotating it thirty-six degrees each instance of bit load removal and reapplication. If the cam ring is forced to rotate before the cooperating surfaces of portion 2 are clear, damage may result.

Figure 5:
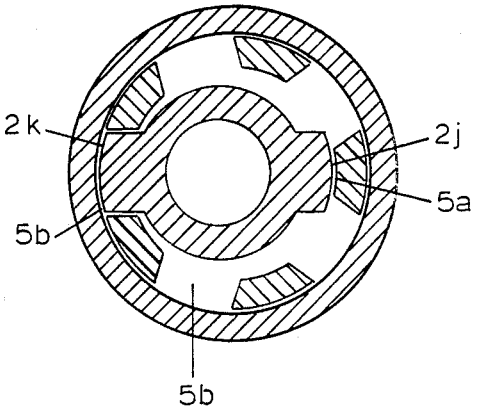
FIG. 5 is a section taken along line 5—5 of FIG. 4.

FIG. 5 is a section through the cam surfaces and shows the relationship between cams 2*k*, 2*j* and 5*a*. There are 5 cams 5*a* and 5 adjacent openings 5*b*. Cam ring 5 is axially constrained for rotation by ring 1*f* and groove 5*c* (note these on FIG. 4).

Cam ring 5 is rotationally driven by lugs 3*c* in grooves 4*b* of drive sleeve 4. Drive sleeve 4 is axially constrained for rotation in body bore 1*a* by cam ring 5 and face 1*g*.

Figure 6:
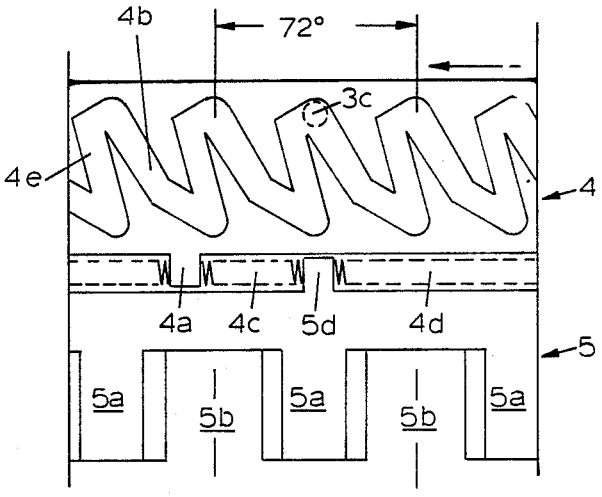
FIG. 6 is a surface development of drive ring 4, cam ring 5 and related parts viewed fron the centerline out.

FIG. 6 is a partial development of surfaces on drive sleeve 4 and cam ring 5 viewed from the centerline outward. Lug 3*c* is assumed to be in the up position shown corresponding with the bit loaded, shortened body, situation. This corresponds to the FIGS. 4 and 5 parts relationships.

The serpentine groove (4*b* and 4*e*) is regarded to be a first selector cam cooperating with second selector cam, lug 3*c*.

It is preferable to rotationally move sleeve 4 when portion 1 is lifted and portion 2 moves down relatively. Lug 3*c* follows groove 4*b* when moving downward. Lug 3*c* is part of washpipe 3 which is rotationally secured to portion 1 by splined flange 3*d* which engages splined bore 1*e*. The washpipe can move axially but cannot rotate. Drive ring 4 moves leftward corresponding with counterclockwise viewed from the top.

Drive ring 4 moves left before cam 2*k* clears the related gap 5*b* in cam ring 5 and the cam ring cannot yet turn. Lugs 4*a* on the drive ring move left compressing springs 4*d*. Springs 4*d*, lugs 5*d* and springs 4*c* are shown only one of each because the development shown spans only about 160 degrees. When portion 2 is clear of the cam ring, spring 4d will turn it until it approximates registry with the selected neutral relationship between the drive ring and the cam ring. Spring 4*c* allows some reverse motion when lug 3*c* moves from the lower end of groove 4*e* to the upper end. The hook shape of groove 4*e* serves to align lug 3*c* over groove 4*b* at the upper travel extreme in preparation for the downward excursion. Grooves 4*b* are also hooked at the bottom to place lug 3*c* under groove 4*e* in preparation for the next upward excursion. To keep the drive ring from moving and randomly positioning the grooves relative to the lug when the lug is at the groove junctions, the drag ring 4*g* is provided. This is an "O" ring but provides enough drag to stabilize the drive ring.

Figure 7:
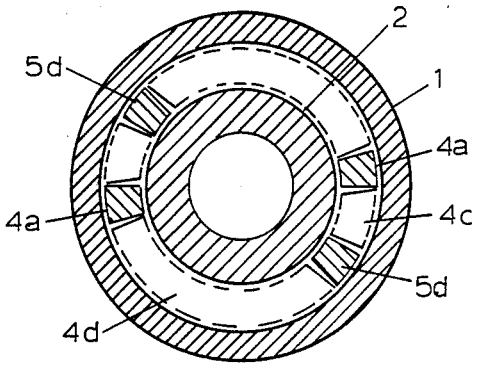
FIG. 7 is a section of FIG. 4 taken along line 7—7.

In FIG. 7, the relationship between lugs 4*a* and 5*d* and springs 4*d* and 4*c* is shown In tools of larger diameter, lugs 3*c* may be put on a collar free to slide but spring positioned on washpipe 3. This arrangement eliminates the need for override bias between the drive ring and the cam ring.

Figure 8:
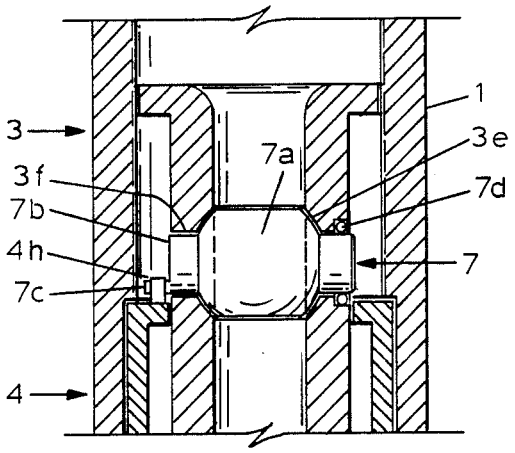
FIG. 8 is a side elevation of a selected area of the tool of FIG. 1 with an alternate valve feature added.

FIG. 8 discloses an optional feature representing means to transmit a fluid pressure signal along the drilling fluid stream in the drill string to indicate, at the surface, that the down hole apparatus is in a specific configuration.

Washpipe 3 is modified to provide a cavity 3*e* for ball valve element 7, and a crossbore 3*f* within which valve trunnion 7*b* can rotate. Trunnion 7*b*, which is part of the valve ball element, has off center crank pin 7*c* which can be engaged by index pin 4*h* on drive ring 4 to rotate the ball valve. Pins 7*c* and 4*h* can engage only when the washpipe is in the lower position and only briefly if ring 4 is moving. Valve 7 causes a limited pressure drop in the most closed position. The valve is biased open by spring 7*d*.

Figure 9:
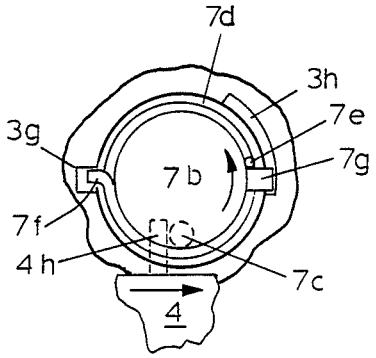
FIG. 9 is a side view of the valve of FIG. 8 showing only a selected portion of the whole.

FIG. 9 is an end view of the right trunnion of FIG. 8 and is somewhat enlarged. Torsion spring 7*d*, coiled about trunnion 7*b*, engages notch 3*g* with hook 7*f* and engages pin 7*g* with hook 7*e* to rotate the trunnion to the position shown, with pin 7*g* stopping the trunnion by contacting the bottom of arcuate groove 3*h*. Drive ring 4 turns in the direction of the arrow thereon and pin 4*h* moves pin 7*c* to rotate the trunnion in the direction of the arcuate arrow to partly close the ball valve and to create a pressure pulse in the drilling fluid stream.

The telescoping tool, when spring biased toward full length, is a column load sensor. Lug 3*c* in grooves 4*b* and 4*e* produce movement equivalent to a load responsive signal to cam ring 5. Cams 2*j* and 2*k* represent deflection control means that is operatively associated with the hinge means, sector 6 and surface 2d, and it is responsive to the cam and lug signal. By alternately shifting from one of the two possible deflection related situations to the other, straightness results from one preselected number of load applications (and incidence of signals) and deflection results from another number of column load applications. Either of the two numbers may be a series selected from a continuum.

From the foregoing, it will be seen that this invention is one well adapted to attain all of the ends and objects hereinabove set forth, together with other advantages which are obvious and which are inherent to the method and apparatus It will be understood that certain features and subcombinations are of utility and may be employed without reference to other features and subcombinations. This is contemplated by and is within the scope of the claims.

As many possible embodiments may be made of the apparatus and method of this invention without departing from the scope thereof, it is to be understood that all matter herein set forth or shown in the accompanying drawings is to be interpreted as illustrative and not in a limiting sense.

The invention having been described, I claim:

1. A drilling tool for use on a drill string, suspended in a well, to enable a driller to selectively alter a down hole drilling assembly for either straight hole drilling or deflected drilling configuration by axial manipulation of the drill string, the tool comprising:

(a) a body adapted to function as a length of the drill string, with drilling fluid conducting means extending therethrough, and comprising: an upper portion and a lower portion, one of said portions, at least in part, telescopingly received within the other and secured therein for limited telescoping movement therein such that column loads through said body tend to shorten said body; hinge means arranged to secure one of said portions to the other and having a transverse axis about which the centerline of said lower portion can pivot between a first configuration generally coincident and a second configuration deflected from an extended general centerline of said upper portion; and rotational drive means comprising a non-circular surface on said upper portion coacting with a non-circular surface on said lower portion;

(b) deflector means, in said body, comprising a first cam and a second cam, both carried on one of said portions, and a movable third cam carried on the other said portion, said movable third cam situated to move between a first position to engage said first cam to force said lower portion to said first configuration and a second position to engage said second cam to force said lower portion to said second configuration, said cams positioned to execute said forcing when said body is shortened by column loads greater than a preselected amount;

(c) deflection selector means, in said body, comprising; said movable third cam and cooperating first and second selector cams, said first selector cam carried on said movable third cam and said second selector cam arranged to move in sympathy with said portion carrying said first and said second cams, said selector cams arranged to be actuated by said telescoping relative movement of said two portions in response to changes in said column loads to move said movable third cam to said first position on preselected instances of application of said column load, in a series of instances of application of said column load, greater than a preselected amount, and to move said movable third cam to said second position on other instances of said series.

2. The tool of claim 1 wherein said movable third cam comprises a plurality of similar individual cams carried on a ring axially secured in said body for rotation around a general body centerline, said individual cams each to perform as said third cam when in position to engage cooperating cams comprising said first and second cams.

3. The tool of claim 1 wherein signal valve means is situated to resist flow through said drilling fluid conducting means, said valve means movable between an open position and a closed position in response to movement of an extension from said third cam to move to said closed position when said movable third cam is in a preselected position and said column loads are changed within preselected limits.

4. The tool of claim 1 wherein said drilling fluid conducting means includes a washpipe arranged to sealingly engage said upper portion and sealingly engage said lower portion to provide a sealed fluid channel extending between said upper portion and said lower portion.

5. The tool of claim 2 wherein said first selector cam is a serpentine groove circumscribing said ring, said second selector cam being a lug on a member arranged to move relative to said ring in response to shortening of said body.

6. The tool of claim 1 wherein a spring is situated in said body, arranged to engage a surface on said lower portion and a surface on said upper portion, to urge said body to extend.

* * * * *